United States Patent [19]

Spinner

[11] 3,963,320

[45] June 15, 1976

[54] CABLE CONNECTOR FOR SOLID-INSULATION COAXIAL CABLES

[76] Inventor: Georg Spinner, ErzgieBereistr. 33, 8 Munich 2, Germany

[22] Filed: June 12, 1974

[21] Appl. No.: 478,595

[30] Foreign Application Priority Data

June 20, 1973 Germany ..... 2331610

[52] U.S. Cl. ..... 339/177 R

[51] Int. Cl.[2] ..... H01R 17/04

[58] Field of Search ..... 339/177, 268

[56] References Cited

UNITED STATES PATENTS

| | | | |
|---|---|---|---|
| 2,152,504 | 3/1939 | Scott et al. | 339/177 R |
| 3,668,612 | 6/1972 | Nepovim | 339/177 R |
| 3,757,279 | 9/1973 | Winston | 339/177 R |
| 3,792,419 | 2/1974 | Spinner | 339/177 R |

*Primary Examiner*—Joseph H. McGlynn
*Attorney, Agent, or Firm*—Ostrolenk, Faber, Gerb & Soffen

[57] ABSTRACT

The disclosure concerns a cable connector for solid-insulation coaxial cables, the outer conductor of which consisting of a thin copper layer that is carried by a dielectric layer and is surrounded externally by a protective sheath of insulating material and a radial contact is established between the part of the outer conductor that is free from the protective sheath and a rigid contact sleeve surrounding said outer conductor, the contact being via a spring contact ring which at the end face is clamped at one edge in a sleeve surrounding the cable in such a manner that said ring is lifted from the outer conductor and pressed by an internally conically extending sleeve radially onto the outer conductor. The sleeve carrying the spring contact ring is constructed as slit conical clamping sleeve which acts on the plastic outer sheath radially by means of a gripping sleeve carrying an inner cone. The collet means constructed in this manner provides reliable securing even with relatively large diameter tolerances of the plastic sheath.

10 Claims, 3 Drawing Figures

CABLE CONNECTOR FOR SOLID-INSULATION COAXIAL CABLES

Figure 1:
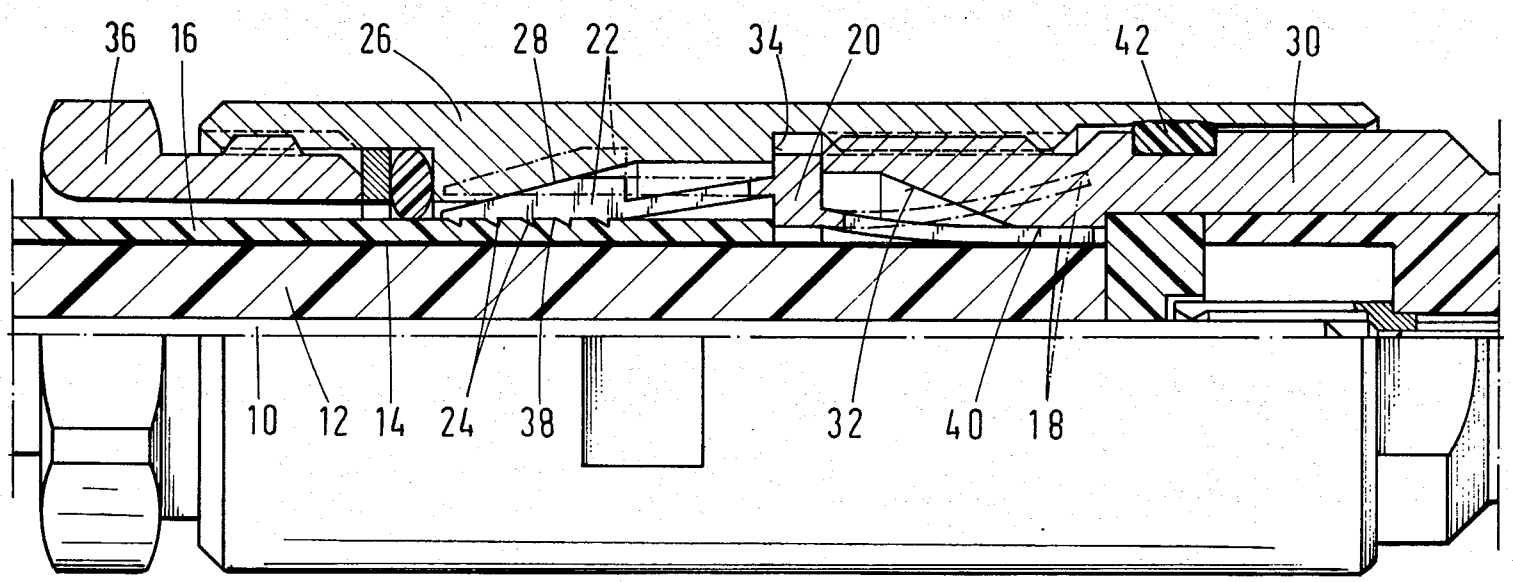

The subject matter of U.S. Pat. Spec. No. 3,792,419 discloses a cable connector for solid-insulation coaxial cables. The outer conductor of this connector consists of a thin copper layer that is carried by the dielectric and that is surrounded externally by a protective sheath of insulating material Radial contact is established between a portion of the outer conductor that is freed from the protective sheath and a rigid contact sleeve surrounding said outer conductor via a spring contact ring which at the end face is clamped at one edge in a sleeve surrounding the cable in such a manner that said ring is lifted from the outer conductor and pressed by an internally conically extending sleeve radially onto the outer conductor. This construction has the advantage that the spring ring bears on the outer conductor with a predetermined contact pressure without being turned with respect to said thin outer conductor, eliminating damage due to any slipping action. Mounting the spring contact ring on the sleeve surrounding the cable results in simple handling because the spring contact ring can be positively fitted with the sleeve onto the cable end.

In the construction described in the U.S. specification the sleeve carrying the spring contact ring is provided with a self-cutting internal thread which may be screwed onto the protective sheath of the cable cover consisting of insulating material. This manner of mechanically securing the cable is satisfactory in every respect provided that the plastic protective sheath of the cable has a definite diameter at the securing point and equal wall thickness at all points of the periphery. However, this requirement is frequently not met, particularly when (relatively cheap) cables are involved which are employed as distributing cables for cable TV within population centers.

The problem underlying the invention is thus to provide a cable connector having mechanical securing which guarantees reliable fixing even with cables with varying plastic outer sheath.

According to the invention this problem is solved in a cable connector according to the U.S. patent in that the sleeve carrying the spring contact ring is constructed as a slit plural sectioned conically externally shaped clamping sleeve which acts on the plastic outer sheath radially by means of a gripping sleeve having an inner conical shape. The collet means constructed in this manner provides reliable securing even with relatively large diameter tolerances of the plastic sheath.

To avoid the collet means penetrating the plastic sheath too much, according to a further development of the invention a fixed stop is provided which limits the radial compression of the clamping sleeve. This stop may be formed by a ring which projects radially outwardly from the clamping sleeve and which may be tensioned between the gripping sleeve and the contact sleeve pressing the spring contact ring radially inwardly. Said stop ring is integrally connected to the spring contact segments of the spring contact ring on the one hand and the clamping tongues of the clamping sleeve on the other.

The internal diameter of the unslit stop ring is, like the spring contact ring bearing thereon, appreciably greater than the nominal diameter of the cable sheath so that easily damaged outer conductors of foil or braid may also be easily introduced without damage. The stop ring may be provided simultaneously as stop for the end annular face of the partially removed plastic outer sheath so that a definite position of the mechanical securing is obtained.

According to a further development of the invention the spring contact ring is not made integrally with the clamping sleeve but as stamped part and for example soldered to the clamping sleeve in accordance with the embodiment of the cited U.S. patent specification.

With the cable connector according to the invention securing is possible by the clamping action on the cable outer sheath without the need of providing a thread in the sleeve carrying the spring contact ring. However, it is preferable to retain this threaded securing according to the cited patent and to improve the penetration of the threads into the outer sheath by the radial collet means and ensure that reliable securing is always obtained even when the outer diameter of the plastic sheath is very irregular. For this purpose the thread may conveniently be made saw-tooth shaped, the steep flank pointing in the direction of greatest axial stress. Instead of helical threads circular threads may be provided if the diameter change of the collet means is made so large that the sleeve carrying the spring contact ring can be freely pushed over the plastic sheath.

Hereinafter an example of embodiment of the invention will be described with the aid of the drawings.

FIG. 1 of the drawings shows a half section through a cable connector mounted on a coaxial cable.

Figure 2:
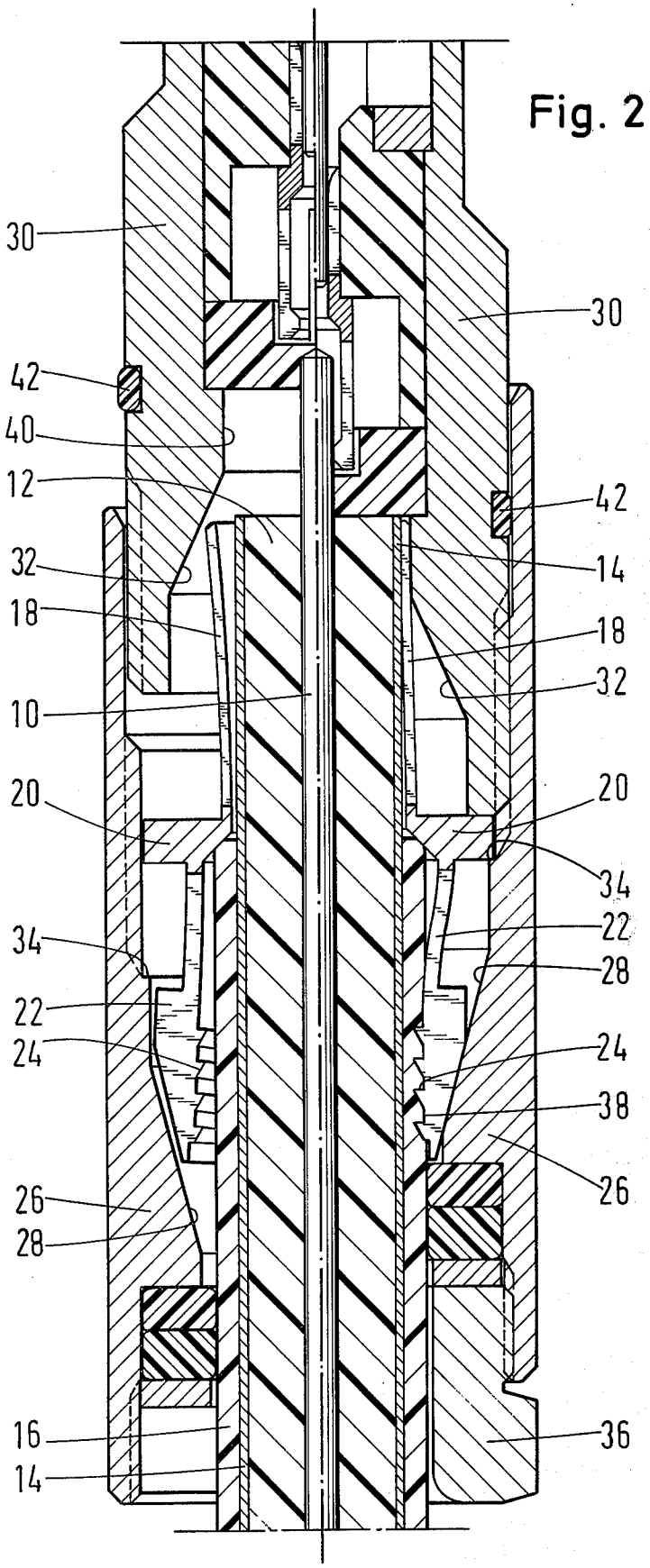
Figure 3:
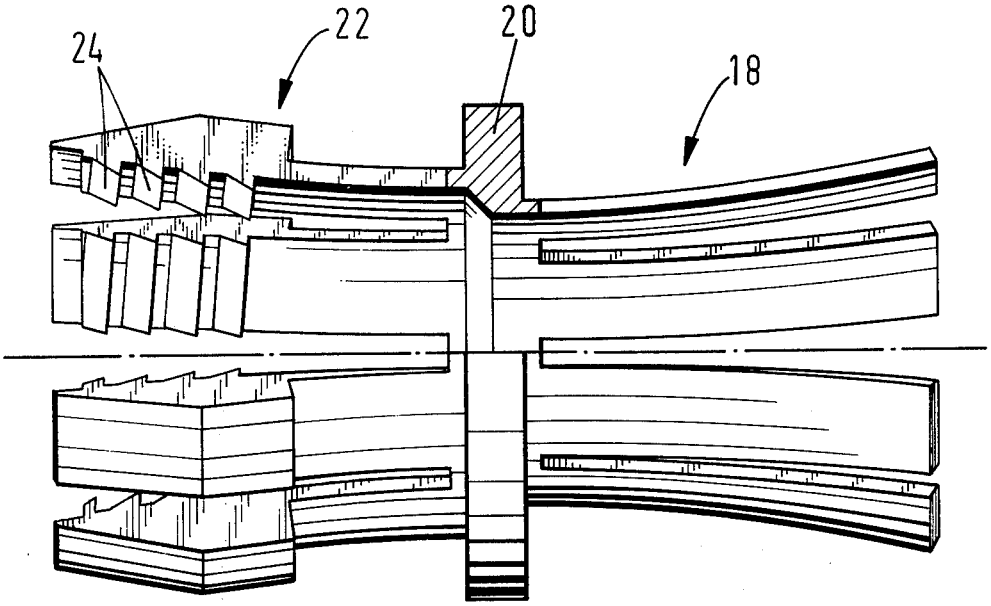

FIG. 2 is a cross-sectional view of the type shown in FIG. 1, with the device of the invention shown in two conditions, before the clamping and after the clamping. and FIG. 3 is a cross-section, elevational view of the clamping sleeve-contact ring element of the present invention.

The cable comprises an inner conductor 10 with a surrounding dielectric 12 and a thin outer conductor 14 in the form of braid or a foil which is carried by said dielectric and enclosed by a plastic protective sheath 16. For establishing electrical contact with the outer conductor the plastic sheath 16 is removed in the front cable portion. The spring contact ring 18 establishing the electrical contact with the outer conductor 14 is in connection at the rearward end with a ring 20 which also carries a collet in the form of a clamping sleeve 22 which is axially slit into several tongue segments. Said clamping sleeve 22 is provided on the inside with a thread 24 or an annular toothing which when the clamping sleeve is radially compressed digs into the plastic sheath 16.

The clamping sleeve, whose tongues form an outer cone, is surrounded by a gripping sleeve 26 which comprises an inner cone shaped opening 28 which cooperates with the outer cone shape of the clamping sleeve, as shown in FIG. 1 and on the lefthand side of FIG. 2. The tensioning is effected via a contact sleeve 30 which carries the connector head and on the outer thread of which the gripping sleeve may be screwed with an inner thread. Said contact sleeve carries as in the construction of cited patent an inner cone shaped opening 32 which when the contact sleeve is axially pushed onto the cable presses the spring contact segments of the ring 18 radially inwardly onto the outer conductor 14. A comparison of the left side of FIG. 2 in the drawings and a view of FIG. 3 which shows the segments of the ring 18 before they are compressed radially inwardly with FIG. 1 and the right side of FIG. 2 which shows the segments of the ring 18 compressed radially inwardly shows the foregoing. In the assembled state (shown in the drawing FIG. 1 in full line and the righthand portion of FIG. 2) the ring 20 bears on a step 34 of the sleeve 26 or the end annular face of the contact sleeve 30 to provide a definite stop which limits the radial compression of the clamping sleeve 22 forming the collet means. The internal diameter of the ring 20 is greater than the diameter of the outer conductor so that sufficient play is present when pushed over the cable to avoid any damage to the sensitive outer conductor. In the inoperative state the spring tongues 18 project outwardly as shown in dot-dash line in the drawing and consequently these tongues are also unable to damage the outer sheath of the cable in any way. To simplify production the inner wall of the clamping sleeve 22 is made cylindrical as shown in dot dash line. It bears because of the conical tightening face 28 of gripping sleeve 26 substantially axis-parallel on the sheath 16 in that the spring tongues bend slightly inwardly as shown to the solid line position of sleeve 22. The diameter is however so chosen that the ring 20 cannot be pushed over the sheath 16 but abuts on the cut-off end annular face thereof, this abutment defining the axial position of the connector on the cable. A stuffing box 36 is screwed for sealing purposes into the rear end of the gripping sleeve 26.

When the gripping sleeve 26 is screwed to the contact sleeve 30 forming the connector body the conical slide face 28 of the gripping sleeve compresses the clamping sleeve 22 until the ring 20 abuts hard on the step 34. Compare the left and right sides of FIG. 2.

The relatively soft resiliency of the segments of the clamping sleeve 22 ensures a reliable connection between the conical tongues and the cable sheath 16 at the point 38. The contacting between the outer conductor 14 and the contact sleeve 30 is at the point 40 via the spring segments 18. Said spring segments 18 in the example of embodiment are fixedly connected to the ring 20. They may however be made as stamped part and inserted and soldered into an endface annular groove of the ring 20. Said tongues 18 slide on assembly along the inner cone shaped surface 32 and to establish the contact are thus inserted between the outer conductor 14 and the inner wall 40 of the contact sleeve 30. The segments 18 are outwardly bent as shown in broken lines in FIG. 1 and in the left side of FIG. 2, and pretensioned as in the construction according to the cited patent so that there is a radial spring contact pressure on the outer conductor 14 when the parts are disposed in the position illustrated in FIG. 1 and the right half of FIG. 2. A sealing ring 42 provides a seal between the gripping sleeve 26 and the contact sleeve 30.

I claim:

1. A cable plug connector for an insulated coaxial cable:

the cable comprises an internal conductor, a dielectric layer outside the internal conductor and supporting an external conductor, a thin metallic external conductor positioned around and supported on the dielectric layer, and an external protective casing of insulating material around the external conductor; an annular section of the cable casing is removed to faciliate electrical and mechanical contact with the exposed contact section of the external conductor;

said connector comprising:

a resilient spring electric contact ring extending around the contact section of the external conductor; said contact ring having a supported edge portion extending toward a clamping sleeve and having an opposite free edge portion opposite its said supported edge portion; said contact ring being so shaped and oriented that its said free edge portion is normally raised above the contact section of the external conductor and its said free edge portion is radially deflectable inwardly against the contact section of the external conductor;

a contact sleeve having an opening therein into which the cable and said contact ring are movable and which said contact sleeve opening is defined by a contact sleeve opening wall; said contact ring being movable into said contact sleeve opening, said contact sleeve opening wall being shaped to engage and cause said contact ring free edge portion to deflect radially inwardly as said contact sleeve is moved toward the clamping sleeve and moved toward and into engagement with a gripping sleeve and this causes said contact ring free edge portion to engage the contact section of the external conductor;

a gripping sleeve over the cable extending toward and meeting with said contact sleeve and also extending over said connector; said gripping sleeve being shiftable on and toward said contact sleeve such that said gripping sleeve and said contact sleeve engage and move together a predetermined distance once they engage; a gripping sleeve opening formed in said gripping sleeve for receiving the cable and for receiving a clamping sleeve and having a gripping sleeve opening wall defining said gripping sleeve opening; said gripping sleeve opening facing toward said contact sleeve opening;

a resilient clamping sleeve having a supported edge portion which is connected with and supported together with said supported edge portion of said contact ring; said clamping sleeve extending away from said contact ring and extending around the cable casing; said clamping sleeve being shaped and oriented to extend into and being movable into said gripping sleeve opening; said clamping sleeve being slit into a plurality of tongues all extending into said gripping sleeve opening; said clamping sleeve tongues having a free edge portion, opposite said clamping sleeve supported edge portion, and said free edge portion is normally raised above the cable and is radially deflectable inwardly against the cable casing; said gripping sleeve opening wall being shaped to engage and cause said clamping sleeve free edge portion to deflect radially inwardly as said gripping sleeve is moved toward and on said contact sleeve and to cause said clamping sleeve to thereby engage the cable casing.

2. The cable plug connector of claim 1, wherein said gripping sleeve opening wall is conically shaped, tapering narrower away from said contact sleeve opening, thereby to force said clamping sleeve free edge portion radially inwardly as said gripping sleeve is moved toward said contact sleeve.

3. The cable plug connector of claim 2, wherein said contact sleeve opening is conically shaped, tapering narrower away from said gripping sleeve opening, thereby to force said contact ring free edge portion radially inwardly as said contact sleeve is moved toward said clamping sleeve.

4. The cable plug connector of claim 2, wherein said clamping sleeve has an interior surface which is engageable with the cable casing and said clamping sleeve interior surface has a cable casing gripping profile thereon.

5. The cable plug connector of claim 2, further comprising an annular support ring extending around the cable and interposed between said contact ring and said clamping sleeve; both said contact ring supported edge portion and said clamping sleeve supported edge portion are connected to said support ring.

6. The cable plug connector of claim 5, further comprising a stop in said gripping sleeve for engaging said support ring when said gripping sleeve is moved a predetermined distance toward said contact sleeve, and said support ring being shaped to be engaged by said stop, thereby to regulate axial tensioning of said clamping sleeve.

7. The cable plug connector of claim 6, wherein said contact sleeve engages said support ring at the side of that said ring away from the engagement between that said ring and said stop.

8. The cable plug connector of claim 5, wherein said support ring has an inner diameter greater than the outer diameter of the cable external conductor; in their inoperative positions, said contact ring free edge portion and said clamping sleeve free edge portion are raised off the cable a distance greater than said support ring inner diameter.

9. The cable plug connector of claim 8, wherein said inner diameter of said support ring is less than the outer diameter of the cable casing, such that said support ring forms an axial stop for the cable at the cut off end of the casing.

10. The cable plug connector of claim 8, wherein said support ring, said contact ring and said clamping sleeve are all formed of and defined in one integral unit.

* * * * *